US007299968B2

(12) United States Patent
Mittmann et al.

(10) Patent No.: US 7,299,968 B2
(45) Date of Patent: Nov. 27, 2007

(54) CONTAINER

(75) Inventors: Ralf Mittmann, Schwelm (DE); Wolfgang Elsenheimer, Ennepetal (DE)

(73) Assignee: Altenloh, Brinck, & Co. GmbH & KG, Ennepetal (DE)

( * ) Notice: Subject to any disclaimer, the term of this patent is extended or adjusted under 35 U.S.C. 154(b) by 127 days.

(21) Appl. No.: 11/225,980

(22) Filed: Sep. 14, 2005

(65) Prior Publication Data

US 2006/0054673 A1 Mar. 16, 2006

(30) Foreign Application Priority Data

Sep. 16, 2004 (DE) ..... 20 2004 014 386 U

(51) Int. Cl.
*B65D 5/38* (2006.01)

(52) U.S. Cl. ..... 229/125.125; 229/220; 229/913

(58) Field of Classification Search ..... 229/125.125, 229/913, 211, 220
See application file for complete search history.

(56) References Cited

U.S. PATENT DOCUMENTS 1,668,234 A 5/1928 Fancher
1,955,633 A * 4/1934 Hill ..... 229/125.125
3,048,319 A 8/1962 Lowe
3,074,611 A * 1/1963 Tolaas ..... 229/125.125
3,332,600 A * 7/1967 Guernsey ..... 229/125.125
3,828,923 A * 8/1974 Phillips, Jr. ..... 229/125.125
3,949,928 A * 4/1976 Perkins ..... 229/125.125
4,524,901 A * 6/1985 Tikka ..... 229/220
5,655,656 A * 8/1997 Gottlieb ..... 229/125.125
6,491,212 B1 * 12/2002 Militzer ..... 229/125.125
2002/0148887 A1 10/2002 Auclair

FOREIGN PATENT DOCUMENTS

DE 8323936 10/1987
DE 890667 7/1989
DE 195 41 904 A1 5/1997

* cited by examiner

*Primary Examiner*—Gary E Elkins
(74) *Attorney, Agent, or Firm*—Brinks Hofer Gilson & Lione

(57) ABSTRACT

The present invention relates to a container, which comprises an inner part (3) for accommodating objects, in particular screws or the like, and an outer part (2) which surrounds the inner part (3) in the closed state of the accommodating container. In this case, the inner part (3) can be entirely accommodated by the outer part (2) and is connected via a closure tab (4), which is formed on the inner part (3), to the outer part (2) in such a manner that the closure tab (4) is fastened to the end of an outer side of the outer part (2), and the closure tab (4) can be severed by a tear-off strip (6), so that the inner part (3) can be released from the outer part.

27 Claims, 6 Drawing Sheets

Fig.1
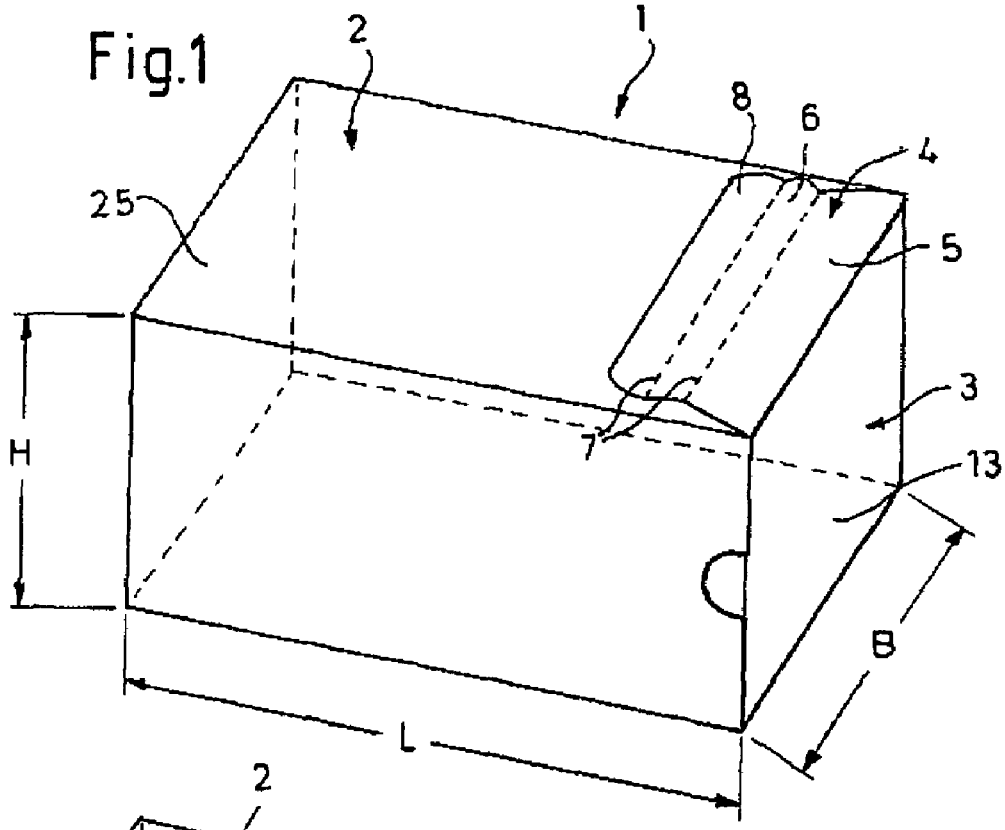
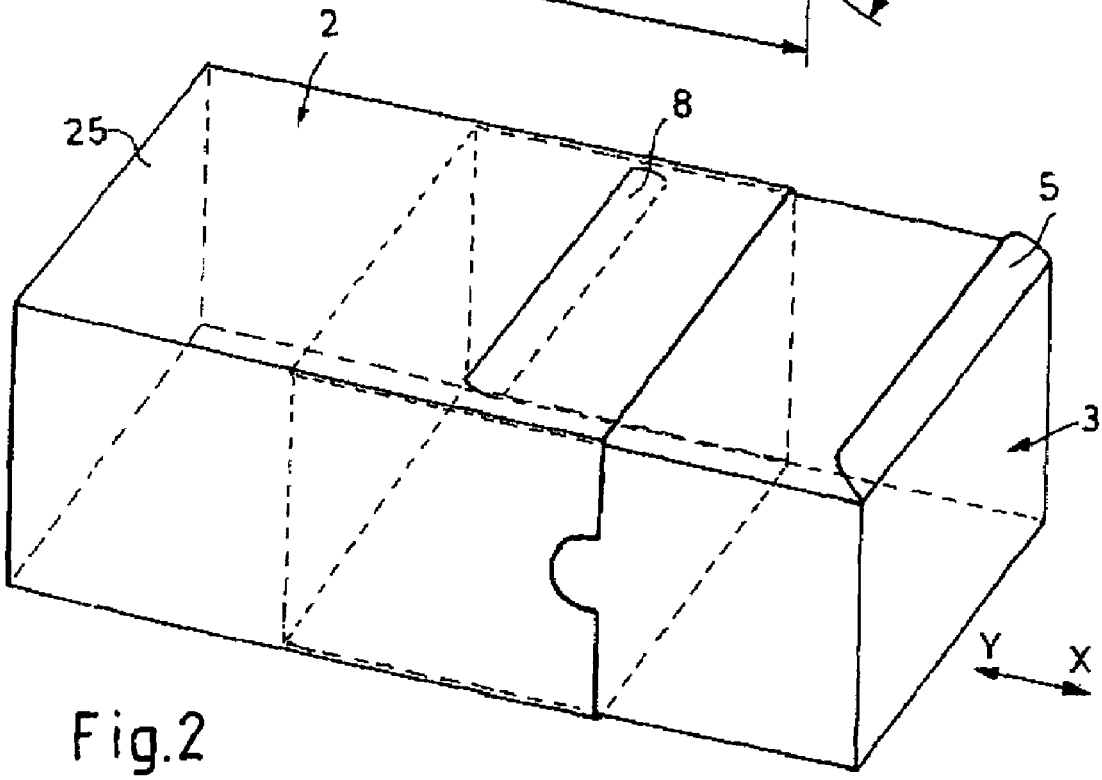
Fig.2

Fig.3
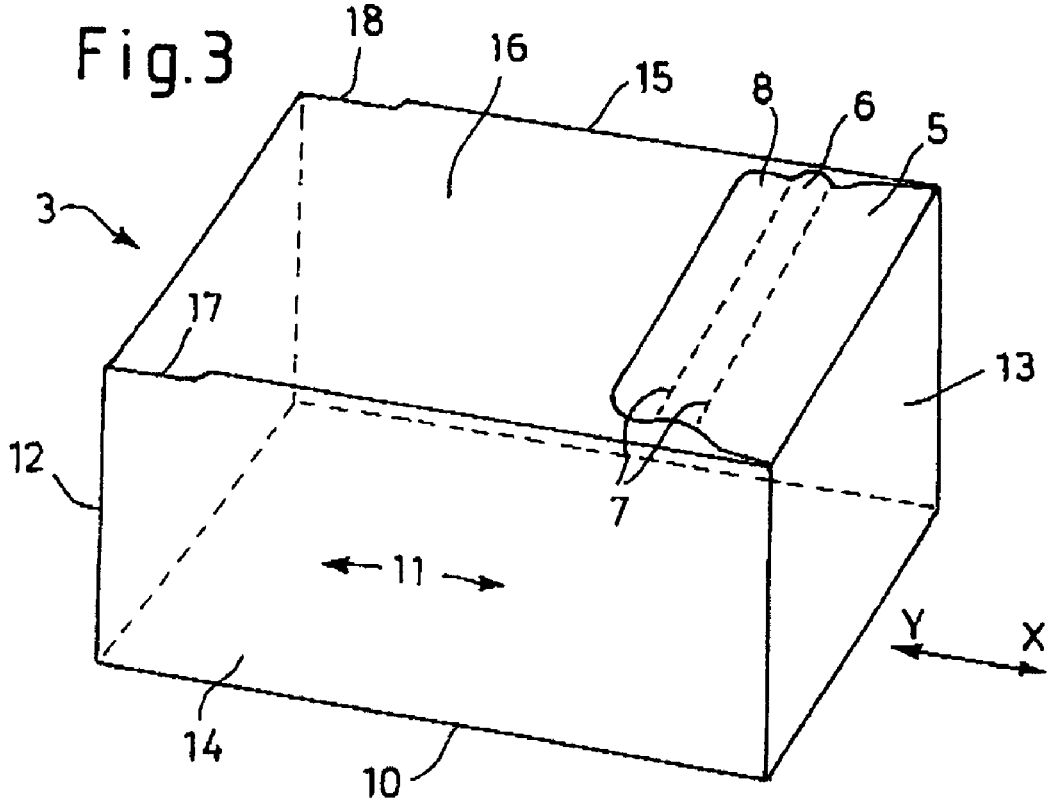
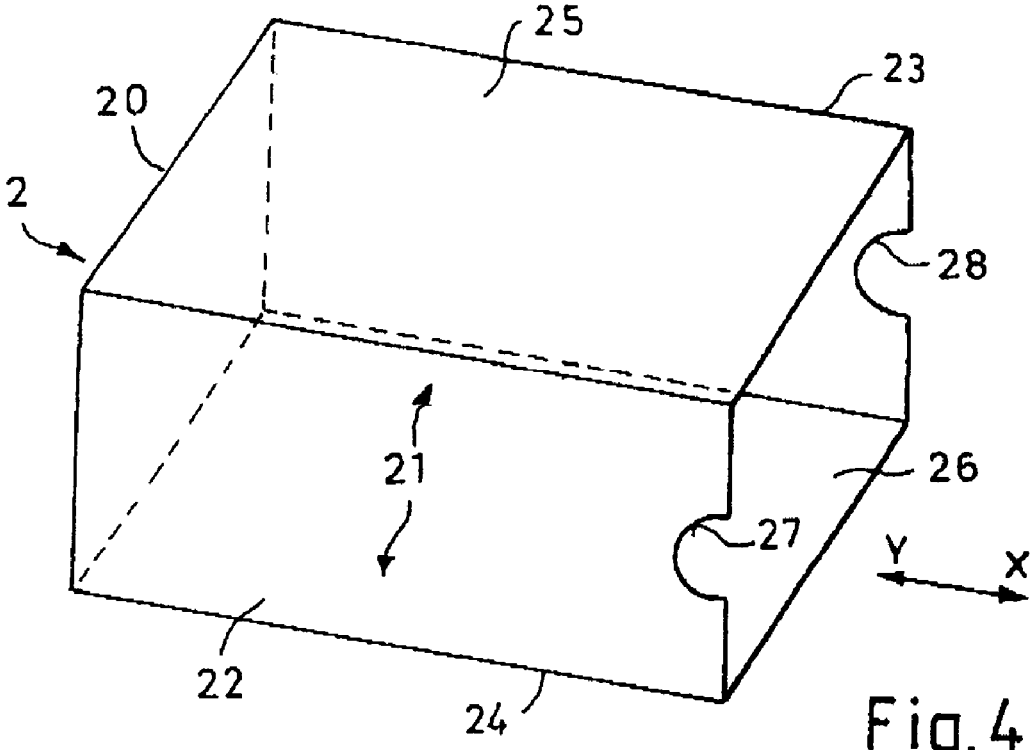
Fig.4

CONTAINER

CROSS REFERENCE TO RELATED APPLICATIONS

This application claims priority to German Utility Patent Application No. 20 2004 014 386.0 filed Sep. 16, 2004.

FIELD OF THE INVENTION

The present invention relates to a container, comprising an inner part for accommodating objects, in particular screws or the like, and an outer part which surrounds the inner part in the closed state of the container.

BACKGROUND OF THE INVENTION

As a packaging container for small parts, folding boxes of generally cuboidal design are well-known. A packaging device of this type is described in DE 195 41 904 A1. In order to make the packaging contents accessible by correct first opening of the packaging, a tear-off tab which detaches part of the packaging wall is often integrated in at least one side wall. For the later continuous removal of the contents, the container has to be able to be opened and freely accessible at least on one side. Although the folding boxes of the prior art can be closed again, the handling in practice, for example a metered removal of screws during an installation process, proves difficult because of the closure device using closure flaps. Containers with drawer elements are more simple and easy to handle. In practice, these permit a more rapid access to their contents and can be arranged in an easily surveyed manner. In addition, this type of container can be stacked, given a suitable embodiment, and therefore reduces the space required. The basic idea of a packing device of this type is shown in DE 42 39 147 A1. This publication does not take into consideration the initial, secure sealability of the container, in order to prevent unauthorized removal of the goods during transportation and presentation, and the possibility of entirely removing the inner part which can be used as a convenient transporting unit during use of the goods.

The present invention is based on the object, starting from the prior art described, of developing a container which permits a secure, initial sealability of the container in conjunction with easy accessibility of the goods in practice with manufacturing costs being kept low and with the space needed for storage and transportation being small.

SUMMARY OF THE INVENTION

According to the present invention, this object is achieved in that the inner part can be entirely accommodated by the outer part and is connected via a closure tab, which is formed on the inner part, to the outer part in such a manner that the closure tab is fastened to the end of an outer surface of the outer part, and the closure tab can be severed by a tear-off strip, so that the inner part can be released from the outer part.

By means of the closure tab according to the invention which is attached to the upper side of the outer part and has a tear-off strip, the goods are reliably stored during transportation and during presentation on sales shelves and are protected from unauthorized removal. After the tear-off strip is detached, a tab section remaining on the inner part can be pushed during later use, with the inner part inserted, under the upper side wall of the outer part and can thereby act in a stabilizing manner, which is of advantage in particular in the case of heavy metal goods.

The division of the container into inner part and outer part in conjunction with a cuboidal configuration makes it possible to arrange a multiplicity of containers next to one another and one above another in a space-saving manner, thus enabling the costs for transportation space, storage space and presentation space to be reduced. The inserted drawer element imparts additional stability to the outer part by means of the double side wall which is produced, which impacts positively on the transportation properties and on the maximum stacking height. The division into two parts also proves advantageous in practice when using the packaged goods, since the goods, while remaining in the drawer element, can be completely removed and are easily accessible at the location of use.

A reduction in the height of the rear wall and a graduation, undertaken at this height, of the two side walls of the drawer element facilitate the insertion of the drawer element.

Grip recesses in the front edges of the side surfaces of the outer part permit the drawer element to be grasped in order to pull it out.

Cost-effective production is obtained by both the drawer element and the outer part, each being produced from a single-part cardboard blank.

BRIEF DESCRIPTION OF THE DRAWINGS

The invention is explained in more detail with reference to the exemplary embodiments illustrated in the attached drawings, in which:

FIG. 1 shows a container according to the invention in the closed state,

FIG. 2 shows a container according to the invention with an inner part which is partially pulled out and is designed as a drawer element, FIG. 3 shows an inner part of the container according to the invention according to FIGS. 1 and 2, which inner part is designed as a drawer element, before it is fitted together to an outer part of the container according to the invention, FIG. 4 shows an outer part of a container according to the invention according to FIGS. 1 and 2.

DETAILED DESCRIPTION OF THE INVENTION

Figure 5:
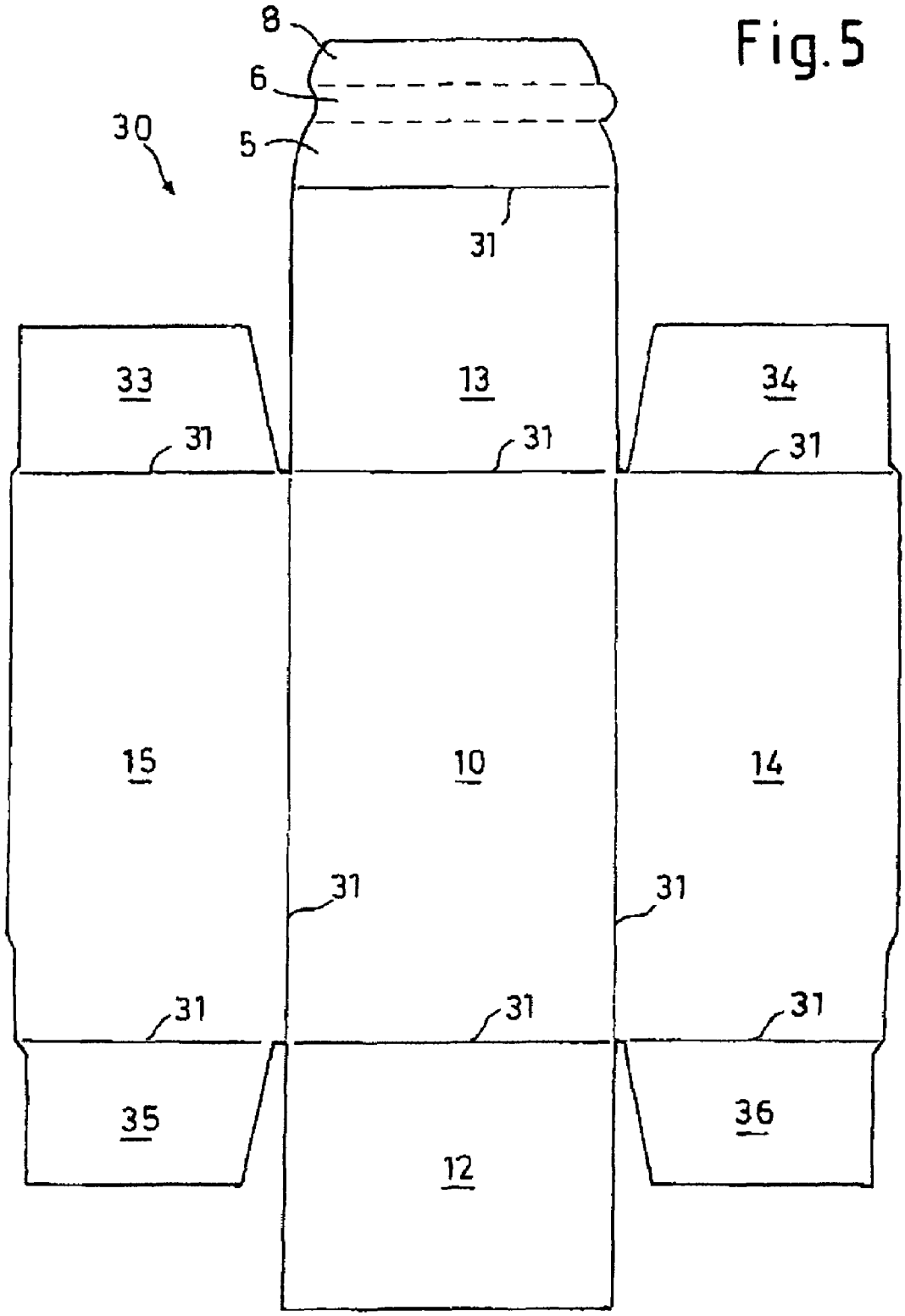
FIG. 5 shows the cardboard blank of an inner part, designed as a drawer element, according to FIG. 3.

FIG. 1 shows a view of a container 1 according to the invention in the closed state, the container comprising an outer part 2 and an inner part 2. The inner part 3 is entirely inserted into the outer part 2 and is connected via a closure tab 4 to the outer part 3, the closure tab 4 having a closure-tab inner section 5 integrally formed on the inner part 3. Before the first opening of the container 1 via a preformed tear-off strip 6, the closure-tab inner section 5 is connected to a closure-tab outer section 8 by means of weakened material portions 7, in particular perforations. By simple pulling on the tear-off strip 6, the latter can be entirely detached over the entire region marked by the perforation and releases the closure-tab inner section 5 while the closure-tab outer section 8 remains on the outside of the outer part 2.

According to FIG. 2, the inner part 3, which is designed as a drawer element, can be pulled out of the outer part in the arrow direction X, with it being possible for the closure-tab inner section 5 which has remained to initially be used as a gripping tab. On reinsertion—arrow direction Y—of the inner part 3 into the outer part 2, double walls which stabilize the container are formed from the inner part 3 and outer part 2.

FIG. 3 shows the inner part 3, which is designed as a drawer element, before it is joined together with the outer part 2. A closed circumferential wall 11, which comprises a rear wall 12, a front wall 13 and side walls 14 and 15 running parallel to the directions of movement X and Y of the inner part 3, is connected to a bottom wall 10. Opposite the bottom wall 10 is an opening 16 for inserting and removing the goods. The rear wall 12 preferably has (as illustrated) a minimally smaller wall height in comparison to the front wall 13 in order to facilitate the insertion of the inner part 3 into the opening 26 of the outer part 2. Correspondingly, the side walls 14 and 15 each have, on their upper edges tapering to the rear wall 12, a section 17, 18 with a wall height reduced to the height of the rear wall 12. The closure-tab inner section 5 is attached to the upper edge of the front wall 13 and merges, bounded by weakened material portions 7 likewise running parallel to this upper edge, into the tear-off strip 6.

FIG. 4 illustrates an outer part 2 of a container according to the invention. The outer part 2 is composed of an end wall 20 on which a closed circumferential wall 21, which comprises side walls 22, 23 and 24, 25 lying opposite each other in each case, is integrally formed. Opposite the end wall 20 is an opening 26 for inserting (arrow direction Y) and removing (arrow direction X) the inner part 3. In this case, the inner part 3, which is designed as a drawer element, is guided by the circumferential wall 21 of the outer part, the end wall 20 of the outer part 2 acting as a stop during the pushing-in movement. Recesses 27, 28 on the opening edge in opposite side walls 22, 23 or 24, 25 permit the inner part 3 to be grasped in order to exert a pulling force on it.

The connection between inner part 3 and outer part 2 before the first opening takes place by the closure-tab outer section 8 being fastened on the outer side of the side wall 25 of the outer part 2. The closure-tab outer section 8 remains there even after the tear-off strip 6 is severed. After the container 1 is opened, the closure-tab inner section 5 can be pushed under the side wall 25 of the outer part 2 as a reinforcing element.

FIG. 5 shows a cardboard blank 30 of an inner part 3, which is designed as a drawer element, with the bottom wall 10, the front wall 13, the side walls 14 and 15 and the rear wall 12. The cuboidal inner part 3 is produced by folding along the folding lines 31 and adhesively bonding by means of the front adhesive tabs 33 and 34 and the rear adhesive tabs 35 and 36.

Figure 6:
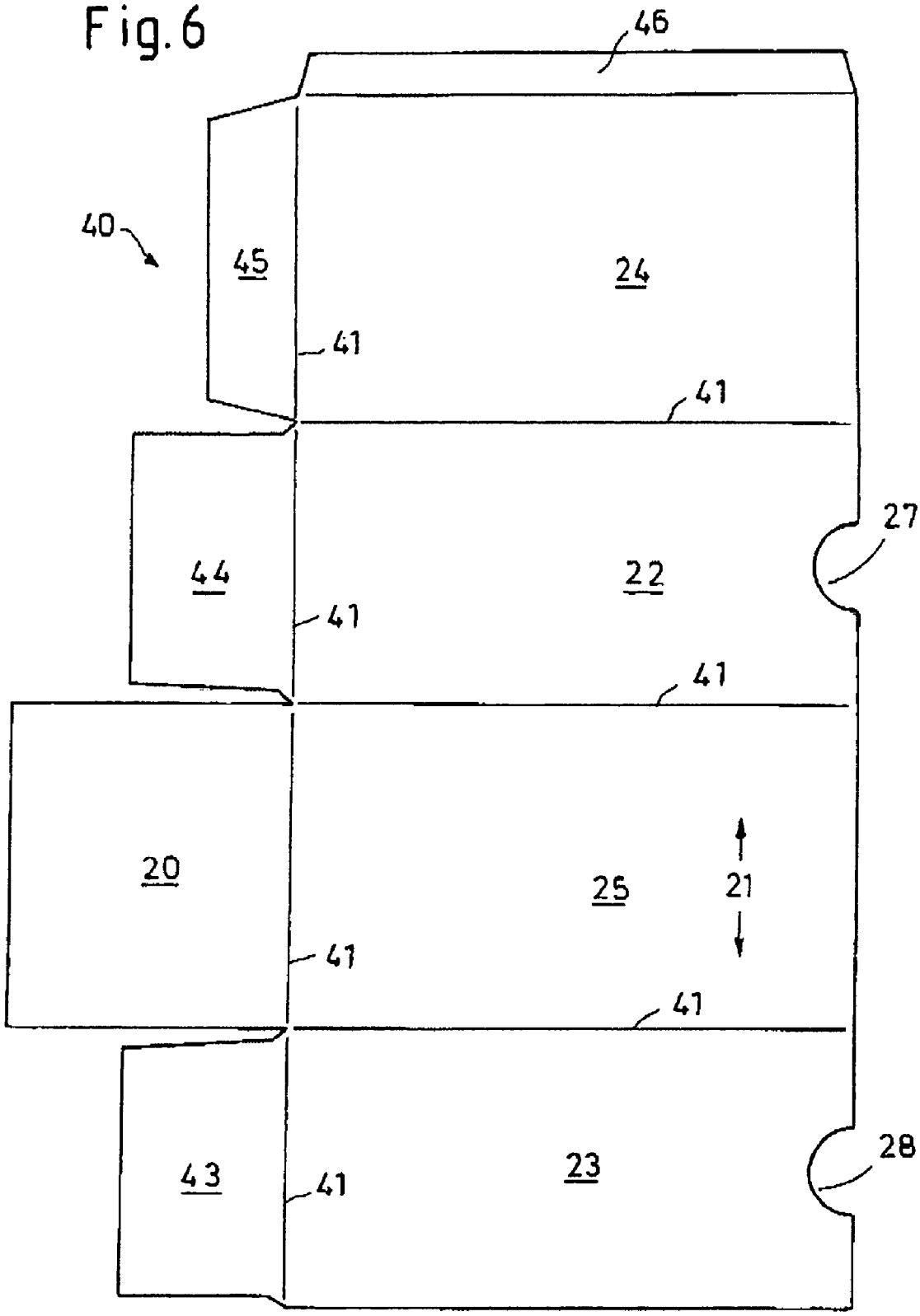
FIG. 6 shows the cardboard blank of an outer part according to FIG. 4.

FIG. 6 shows a cardboard blank 40 of the outer part 2 with the circumferential wall 21, comprising the side walls 22, 23, 24, 25 and an end wall 20 acting as a drawer-element stop. On the lateral walls 22 and 23, the (grip) recesses 27, 28 are incorporated into the opening edge. The cuboidal outer part 2 is produced by folding along the folding lines 41 and adhesively bonding by means of the lateral end adhesive tabs 43 and 44, the lower end adhesive tab 45 and the circumferential adhesive tab 46.

The embodiment illustrated in FIGS. 1 to 6 describes the basic form of the container 1, with the side wall 24 of the outer part 2 generally being used as the standing surface and the closure tab 4 therefore being attached to the outer side of the side wall 25 on the upper side of the container 1.

Figure 7:
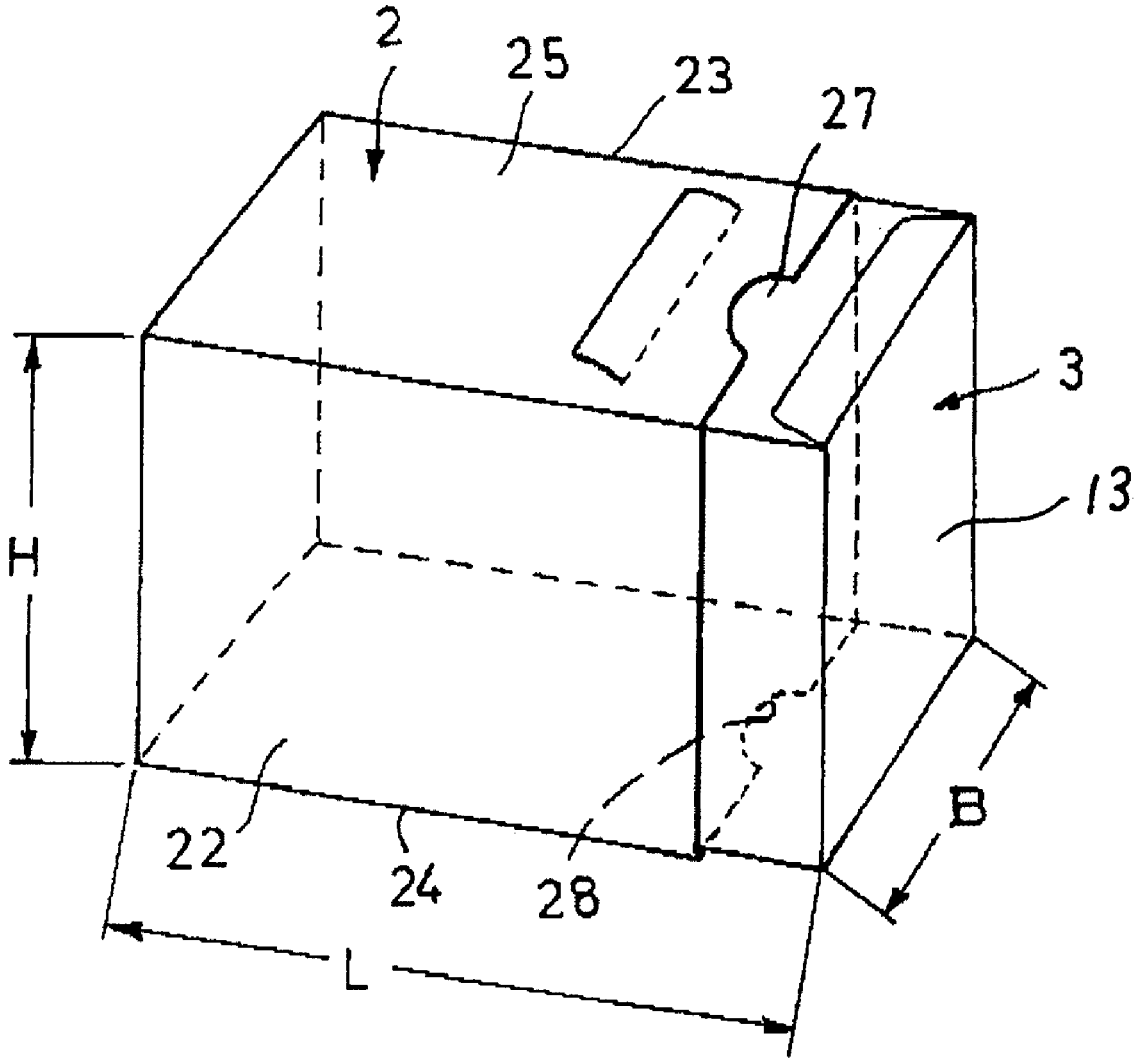
FIG. 7 shows a further embodiment (abbreviated form) of the container according to the invention with an inner part which is partially pulled out and is designed as a drawer element.

FIG. 7 shows an alternative embodiment which is designed as an abbreviated form and differs from the basic form illustrated in FIGS. 1 to 6 in that, with the wall height H remaining the same, the dimensions of the standing surface (side wall 24), described by the length L and the breadth B, have been approximately halved. The dimensions (length L and height H) of the side walls 22, 23 correspond to the dimensions (breadth B and height H) of the front wall 13 in FIGS. 1 to 6. In addition, the (grip) recesses 27, 28 are incorporated in the side walls 24 and 25. As in the case of the basic form, the closure-tab outer section 8 is adhesively bonded to the side wall 25.

Figure 8:
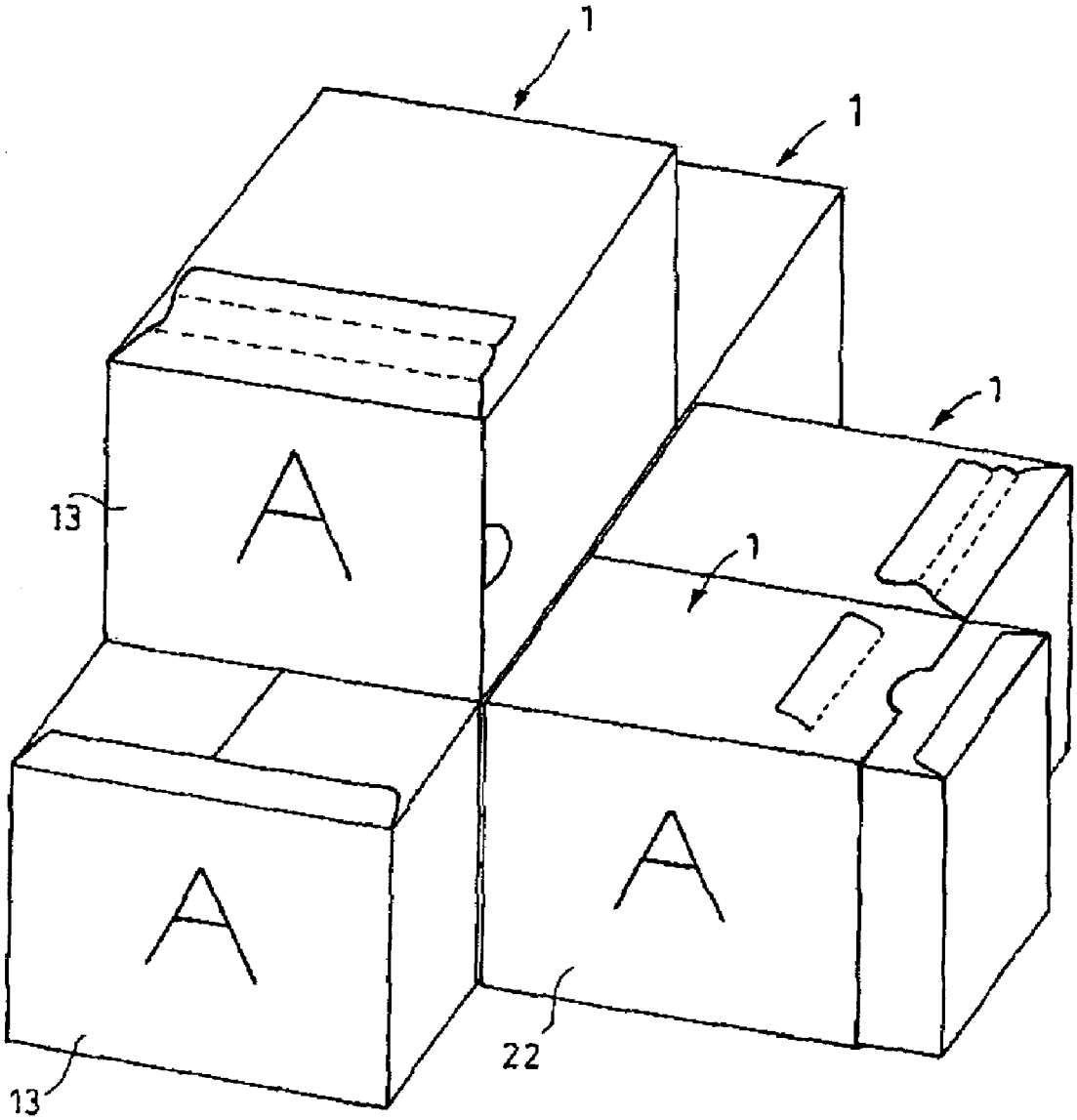
FIG. 8 shows a stacking arrangement with basic and abbreviated forms of the container according to the invention.

FIG. 8 shows a stacking arrangement with various embodiments of the container according to the invention. It can be seen therein that, in the abbreviated form according to FIG. 7, the side wall 22 of the outer part can be used as a printable identification surface, since, in the stacked state of the container according to the invention, it is freely visible from the front side of the stack. In the case of the basic forms according to FIGS. 1 to 6, the front wall 13 is used as the identification surface.

The invention is not confined to the exemplary embodiments illustrated and described, but encompasses all embodiments of equivalent effect within the meaning of the invention. Furthermore, the invention is also not yet confined to the combination of features defined in claim 1 but can also be defined by any other desired combination of particular features of all disclosed individual features. This means that, in principle, virtually any individual feature of claim 1 can be omitted or replaced by at least one individual feature disclosed elsewhere in the application. To this extent, claim 1 is to be understood merely as a first attempt at formulating an invention.

While the above description constitutes the preferred embodiment of the present invention, it will be appreciated that the invention is susceptible to modification, variation and change without departing from the proper scope and fair meaning of the accompanying claims.

The invention claimed is:

1. A container for accommodating objects, including screws or the like, the container comprising an inner part and an outer part which surrounds the inner part in a closed state of the container, wherein the inner part can be entirely accommodated by the outer part and is connected to the outer part via a closure tab, which is formed on the inner part in such a manner that the closure tab is fastened at an end to an outer side of the outer part, and the closure tab can be severed by a tear-off strip, so that the inner part can be released from the outer part, the outer part includes an outer part end wall attached to a closed outer part circumferential wall, the outer circumferential wall including four outer part side walls and an outer part opening lying opposite the outer part end wall, and the inner part includes an inner part bottom wall an attached closed inner part circumferential wall, the inner part circumferential wall having an inner part rear wall, an inner part front wall and two opposite inner part side walls and an inner part opening lying opposite the inner part bottom wall, wherein the inner part is designed as a drawer element and can be entirely pulled out of the outer part and can be inserted with its inner part rear wall into the outer part opening and can be pushed in as far as the outer part end wall, which outer part end wall acts as a stop, so that the inner wall front wall closes the outer part opening and one of the outer part side walls opposite the standing surface covers the inner part opening.

2. The container as claimed in claim 1, wherein one outer part side wall is a standing surface and the closure tab is attached to an outer side of an outer part side wall which lies opposite the standing surface.

3. The container as claimed in claim 1, wherein the inner part and the outer part are of cuboidal design.

4. The container as claimed in claim 1, wherein the outer part side walls are attached perpendicular to one another and at least two of the outer part side walls lie opposite each other and have respective recess adjacent the outer part opening to permit the inner part to be grasped.

5. The container as claimed in claim 1, wherein one outer part side wall is a standing surface and two side walls lying opposite one another each have a recess adjacent the outer part opening.

6. The container as claimed in claim 1, wherein the outer part is produced from a single-part cardboard blank.

7. The container as claimed in claim 1, wherein the inner part is produced from a single-part cardboard blank.

8. The container as claimed in claim 1, wherein in the dimensions of the inner part front wall are identical to the dimensions of the outer part side walls.

9. The container as claimed in claim 8, wherein a plurality of the containers may be arranged above another and next to one another, such that the inner part front wall of all of the respective containers lie in common plane with at least one respective outer part side wall of all of the other containers.

10. A container for accommodating objects, including screws or the like, the container comprising an inner part and an outer part which surrounds the inner part in a closed state of the container, wherein the inner part can be entirely accommodated by the outer part and is connected to the outer part via a closure tab, which is formed on the inner part in such a manner that the closure tab is fastened at an end to an outer side of the outer part, and the closure tab can be severed by a tear-off strip, so that the inner part can be released from the outer part, the outer part includes an outer part end wall attached to a closed outer part circumferential wall, the outer part circumferential wall including four outer part side walls and an outer part opening lying opposite the outer part end wall, and the inner part includes an inner part bottom wall and an attached closed inner part circumferential wall, the inner part circumferential wall having an inner part rear wall, an inner part front wall and two opposite inner part side walls and an inner part opening lying opposite the inner part bottom wall, wherein the inner part rear wall has a reduced wall height in comparison to the height of the inner part front wall.

11. The container as claimed in claim 10, wherein one outer part side wall is a standing surface and the closure tab is attached to an outer side of an outer part side wall which lies opposite standing surface.

12. The container as claimed in claim 10, wherein the inner part and the outer part are of cuboidal design.

13. The container as claimed in claim 10, wherein the outer part side walls are attached perpendicular to one another and at least two of the outer part side walls lie opposite each other and have respective recess adjacent the outer part opening to permit the inner part to be grasped.

14. The container as claimed in claim 10, wherein one outer part side wall is a standing surface and two side walls lying opposite one another each have a recess adjacent the outer part opening to permit the inner part to be grasped.

15. The container as claimed in claim 10, wherein the outer part is produced from a single-part cardboard blank.

16. The container as claimed in claim 10, wherein the inner part is produced from a single-part cardboard blank.

17. The container as claimed in claim 10, wherein in the dimensions of the inner part front wall are identical to the dimensions of the outer part side walls.

18. The container as claimed in claim 17, wherein a plurality of the containers may be arranged one above another and next to one another, such that the inner part front wall of all of the respective containers lie in common plane with at least one respective outer part side wall of all of the other containers.

19. A container for accommodating objects, including screws or the like, the container comprising an inner part and an outer part which surrounds the inner part in a closed state of the container, wherein the inner part can be entirely accommodated by the outer part and is connected to the outer part via a closure tab, which is formed on the inner part in such a manner that the closure tab is fastened at an end to an outer side of the outer part, and the closure tab can be severed by a tear-off strip, so that the inner part can be released from the outer part, the outer part includes an outer part end wall attached to a closed outer part circumferential wall, the outer part circumferential wall including four outer part side walls and an outer part opening lying opposite the outer part end wall, and the inner part includes an inner part bottom wall and an attached closed inner part circumferential wall, the inner part circumferential wall having an inner part rear wall, an inner part front wall and two opposite inner part side walls and an inner part opening lying opposite the inner part bottom wall, wherein the inner part side walls which run from the inner part front wall to the inner part rear wall each have a section adjacent to the inner part rear wall in which the wall height is reduced from the height of the inner part front wall to the height of the inner part rear wall.

20. The container as claimed in claim 19, wherein one outer part side wall is a standing surface and the closure tab is attached to an outer side of an outer part side wall which lies opposite the standing surface.

21. The container as claimed in claim 19, wherein the inner part and the outer part are of cuboidal design.

22. The container as claimed in claim 19, wherein the outer part side walls are attached perpendicular to one another and at least two of the outer part side walls lie opposite each other and have respective recess adjacent the outer part opening to permit the inner part to be grasped.

23. The container as claimed in claim 19, wherein one outer part side wall is a standing surface and two side walls lying opposite one another each have a recess adjacent the outer part opening to permit the inner part to be grasped.

24. The container as claimed in claim 19, wherein the outer part is produced from a single-part cardboard blank.

25. The container as claimed in claim 19, wherein the inner part is produced from a single-part cardboard blank.

26. The container claimed in claim 19, wherein in the dimensions of the inner pert front wall are identical to the dimensions of the outer part side walls.

27. The container as claimed in claim 26, wherein a plurality of the containers may be arranged one above another and next to one another, such that the inner part front wall of all of the respective containers lie in common plane with at least one respective outer part side wall of all of the other containers.

* * * * *

UNITED STATES PATENT AND TRADEMARK OFFICE

CERTIFICATE OF CORRECTION

PATENT NO. : 7,299,968 B2
APPLICATION NO. : 11/225980
DATED : November 27, 2007
INVENTOR(S) : Ralf Mittmann and Wolfgang Elsenheimer It is certified that error appears in the above-identified patent and that said Letters Patent is hereby corrected as shown below:

On the Title Page, Item (73)
On the patent cover page under Assignee, please delete "Altenloh, Brinck, & Co. GmbH & KG" and insert -- Altenloh, Brinck, & Co. GmbH & Co. KG --.

In Claim 9, line 24, col. 5 after "arranged" insert -- one --.

In Claim 11, line 52, col. 5 after "opposite" insert -- the --.

In Claim 26, line 56, col. 6 delete "pert" and insert -- part --.

Signed and Sealed this

Thirteenth Day of May, 2008

JON W. DUDAS
*Director of the United States Patent and Trademark Office*